US005924916A

United States Patent [19]

Yamashita

[11] Patent Number: 5,924,916

[45] **Date of Patent: *Jul. 20, 1999**

[54] APPARATUS AND METHOD FOR POLISHING A SEMICONDUCTOR WAFER

[75] Inventor: Junichi Yamashita, Miyazaki-gun, Japan

[73] Assignee: Komatsu Electronic Metals Co., Ltd., Hiratsuka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,838

[22] Filed: Dec. 23, 1996

[30] Foreign Application Priority Data

Dec. 27, 1995 [JP] Japan ..... 7-354794

[51] Int. Cl.[6] ..... B24B 7/22

[52] U.S. Cl. ..... 451/288; 451/41

[58] Field of Search ..... 451/288, 287, 451/290, 41, 5, 57

[56] References Cited

U.S. PATENT DOCUMENTS 3,611,654 10/1971 Weber ..... 451/288
4,009,539 3/1977 Day ..... 451/288
5,329,732 7/1994 Karlsrud et al. ..... 451/290
5,562,524 10/1996 Gill, Jr. ..... 451/285

FOREIGN PATENT DOCUMENTS 9227361 12/1984 Japan ..... 451/287
8-236489 9/1996 Japan .

*Primary Examiner*—Robert A. Rose
*Attorney, Agent, or Firm*—Varndell Legal Group

[57] ABSTRACT

An apparatus for polishing semiconductor wafers is provided which is capable of efficiently polishing the semiconductor wafers one-by-one by a multi-step polishing, capable of preventing occurrence of spots and scratches due to attachment and detachment to and from top rings, and capable of polishing the semiconductor wafers with high-flatness surfaces. The polish apparatus includes a plurality of holding shafts for holding the semiconductor wafers, a polish table on which the semiconductor wafers are placed and polished, and means for upwardly and downwardly moving the semiconductor wafers which are held by the holding shafts, in which the upward and downward movement of the holding shafts and the attachment and detachment of the semiconductor wafers to and from the holding shafts are independently carried out for each of the holding shafts.

13 Claims, 4 Drawing Sheets

APPARATUS AND METHOD FOR POLISHING A SEMICONDUCTOR WAFER

BACKGROUND OF THE INVENTION

1. Field of the Invention

The present invention relates to an apparatus for polishing semiconductor wafers, and more specifically to an apparatus for mirror polishing the surfaces of the semiconductor wafers.

2. Description of Related Art

In order to increase the yield in the device process, a demand for the flatness of semiconductor wafers keeps increasing these days. For satisfying the demand for the high-flatness, the process technology before polishing has been improved whereby it has become possible to obtain semiconductor wafers having a uniform thickness. However, there is a drawback that a convex-surface effect occurs as being polished in the polishing step performed subsequently, which destroys the high-flatness. It -has been already known that the convex-surface effect acceleratedly increases when a duration of the polishing time exceeds a certain period of time.

Therefore, in order to maintain the high-flatness, there is provided a multi-step polishing method in which, the polishing is carried out until the convex-surface effect begins to increase and, after a certain rest time has elapsed, the polishing is carried out again; this procedure is repeated again and again, whereby semiconductor wafers with lesser convex-surface effect can be obtained.

To realize this multi-step polishing method, as shown in FIG. 4, there is a method of polishing wafers one by one with the use of conventional single wafer polishing apparatus, in which conventional single wafer polishing apparatus 4*a*–4*c* are disposed and transfer apparatus 5*a*–5*b* are arranged between the conventional single-wafer polish apparatus 4*a*–4*c*. That is, a semiconductor wafer 10 is polished, step-by-step, by each of the single-wafer polish apparatus as it is transferred between the polish apparatus by the transfer apparatus 5*a* and 5*b*.

However, in the case where the multi-step polishing is carried out while processing the wafers one by one with the use of the conventional single-wafer polishing apparatus, it is required that the number of polish apparatus and the number of transfer apparatus must be equal to the number of steps of the multi-step polishing, hence there is a problem that a space required for the polishing becomes too large.

Moreover, because attaching and detaching to and from top rings must be repeated while moving between the plurality of polishing apparatus and transfer apparatus, there has been a problem that spots and scratches tend to occur.

SUMMARY OF THE INVENTION

The present invention has been made in view of the above-mentioned problems and aims to provide an apparatus for polishing semiconductor wafers, which is capable of realizing the polishing of the semiconductor wafers with a high-flatness by means of a multi-step polishing method in which the wafers are efficiently polished one-by-one and capable of preventing spots and scratches occurred due to attachment and detachment of the wafers to and from the top rings.

The polish apparatus of the invention includes a plurality of holding shafts each for holding a semiconductor wafer, a polish table on which the semiconductor wafers are placed and polished, and means for upwardly and downwardly moving the semiconductor wafers which are held by the holding shafts, in which the upward and downward movement of the holding shafts and the attachment and detachment of the semiconductor wafers to and from the holding shafts are performed independently for each of the holding shafts.

Preferably, the invention may be so arranged that the number of polishing steps required for each semiconductor wafer and the duration for each polishing step are preset, and a controller is provided for controlling the attachment of the semiconductor wafers to the holding shafts and the upward and downward movement of the holding shafts according to the preset values so as to carry out the attachment and detachment of the semiconductor wafers to and from the holding shafts and the upward and downward movement of the holding shafts synchronously.

The polish table may be a polishing cloth.

Preferably, the number of the holding shafts of the controller may be equal to the number of polishing steps required for each of the semiconductor wafers.

That is, the present invention is so arranged that, in one polish apparatus, more than two holding shafts such as top rings for attaching the semiconductor wafers are provided for one base plate having a polishing cloth fixed thereto and that the upward and downward movement of the holding shafts are controlled independently and the attachment and detachment of the semiconductor wafers to and from the holding shafts are controlled independently as well.

Now, the method of polishing control in the respective holding shafts is described with reference to a flowchart shown in FIG. 2.

(1) The semiconductor wafers are attached to the holding shafts such as top rings (S1).

(2) The holding shafts are descended so that the semiconductor wafers contact with the polishing cloth, and the base plate is rotated to polish the semiconductor wafers (S2).

(3) The holding shafts are lifted to temporarily stop polishing. At this time, a confirmation is made as to whether or not the prescribed number of polishing is satisfied (S3).

(4) If the prescribed number of polishing is not satisfied, after confirming the completion of attachment of a semiconductor wafer to another holding shaft, the holding shafts are descended to perform the polishing step again (S2).

(5) Until the attachment of the semiconductor wafer to another holding shaft, the polishing is posed (polish rest time) (S6).

(6) If the prescribed number of polishing is satisfied, the semiconductor wafer is removed from the holding shaft (S5). At this time, a confirmation is made as to whether or not a next semiconductor wafer is to be polished.

(7) When a next semiconductor wafer is to be polished, a semiconductor wafer is attached again (S1).

(8) When a next semiconductor wafer is not to be polished, the polishing with that holding shaft is terminated.

In such a way, by synchronously controlling the attachment, and detachment of the semiconductor wafers to and from the holding shafts and the upward and downward movement of the holding shafts, the multi-step polishing is carried out sequentially in order, under such a condition that each of the semiconductor wafer is attached to the same holding shaft, respectively, whereby there can be achieved an excellent advantage that the semiconductor wafers can be efficiently processed one by one.

In addition, since the multi-step polishing can be carried out with the semiconductor wafers being attached on the same top rings, there is an excellent advantage that occurrence of spots and scratches due to attaching and detaching to and from the top rings can be prevented.

PREFERRED EMBODIMENTS OF THE INVENTION

An embodiment of the invention will be described in accompaniment with the drawings.

The polish apparatus of the embodiment polishes the wafers in three steps. That is, three short-period polishing steps for each of the wafers are carried out.

Figure 1:
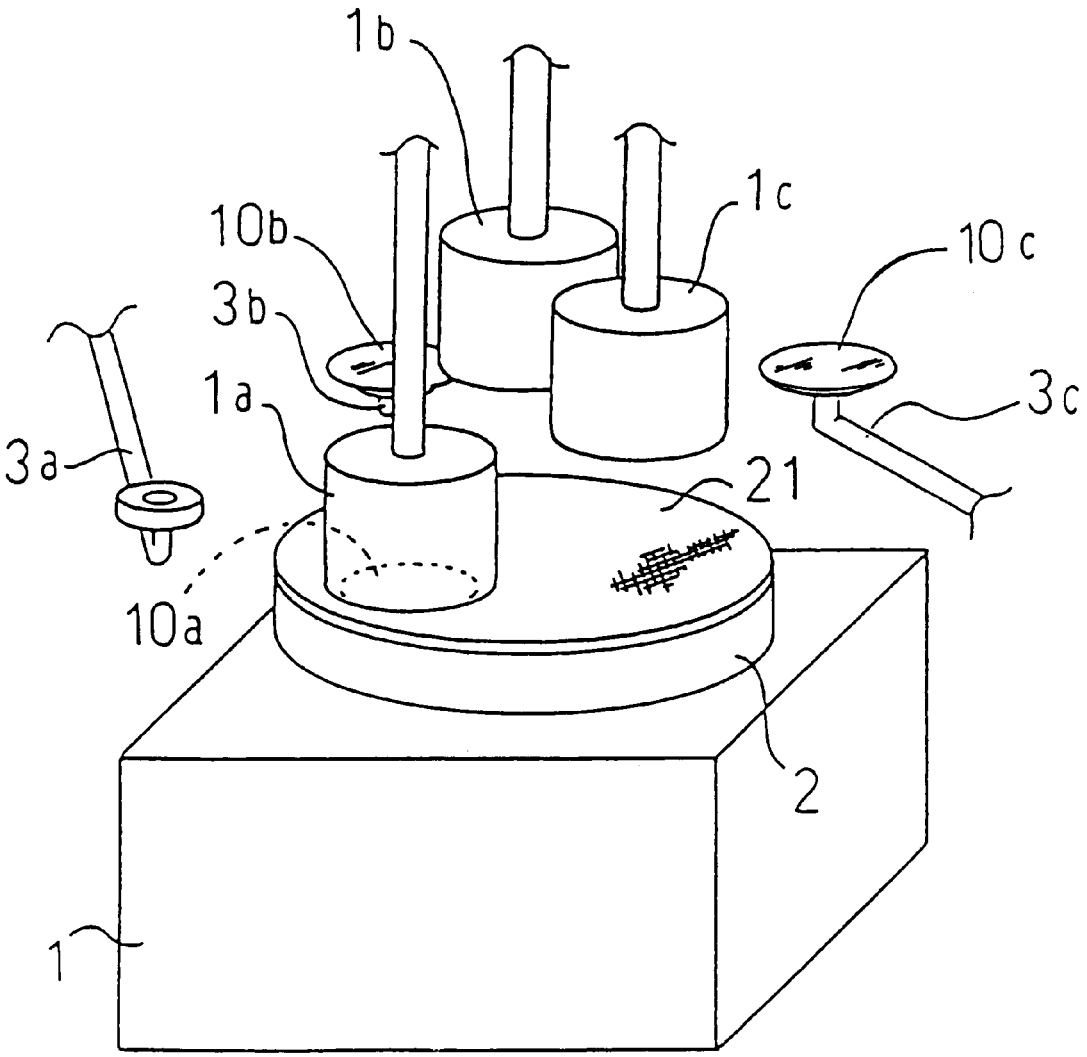
FIG. 1 illustrates a perspective view of a polish apparatus of the present invention.
Figure 2:
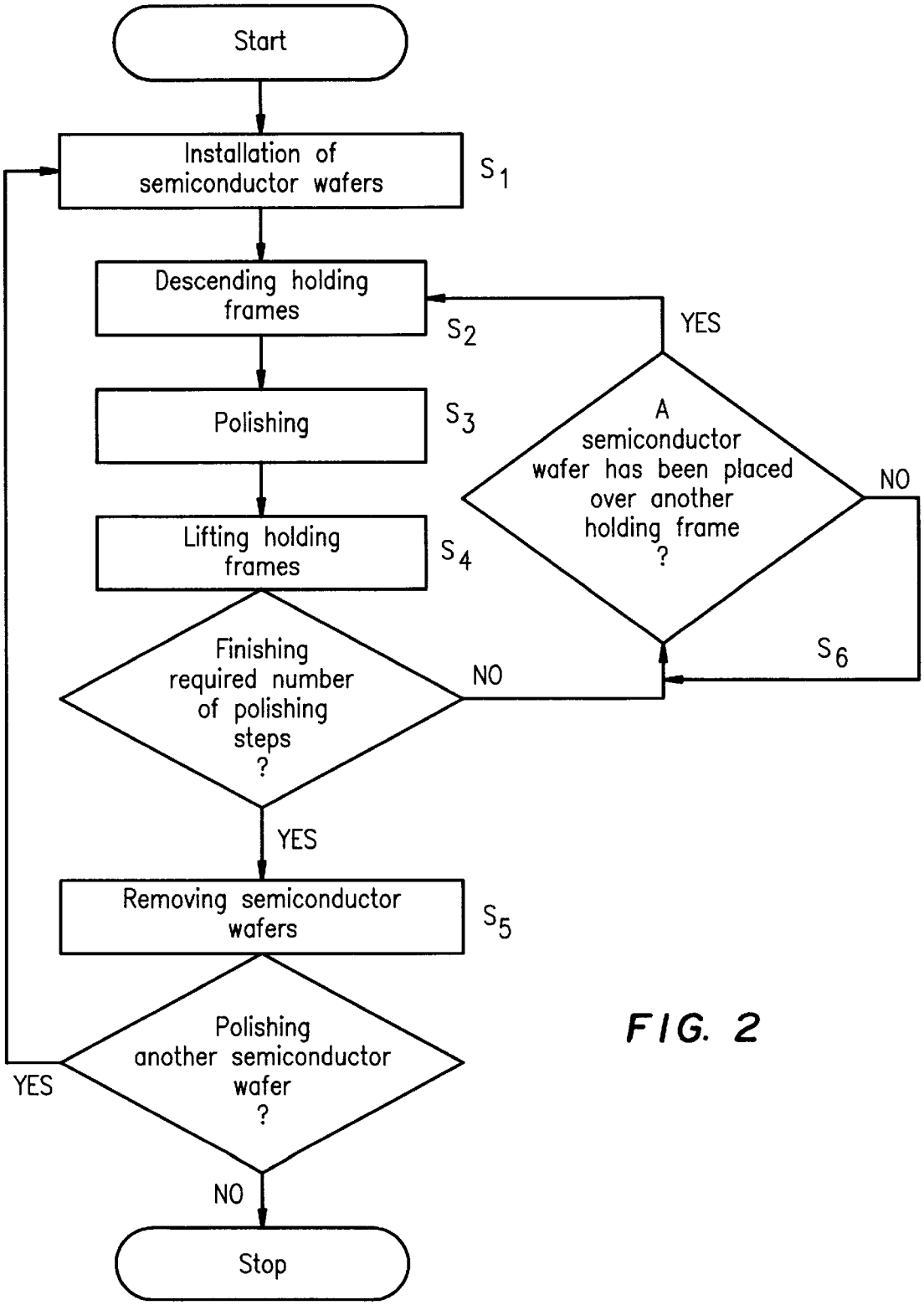
FIG. 2 is a flowchart showing a method of polishing control in each holding shaft.
Figure 3A:
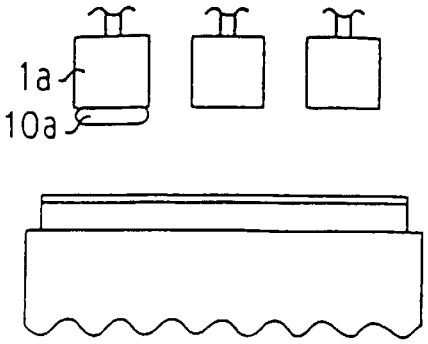
FIG. 3 illustrates the polishing sequence by the polish apparatus of the present invention.
Figure 3B:
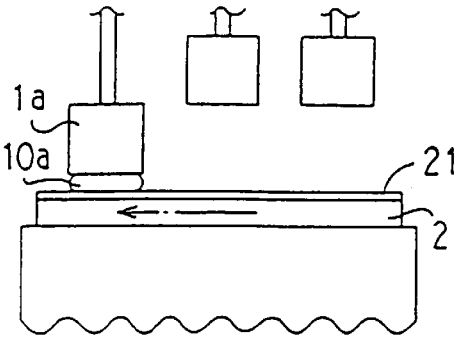
Figure 3C:
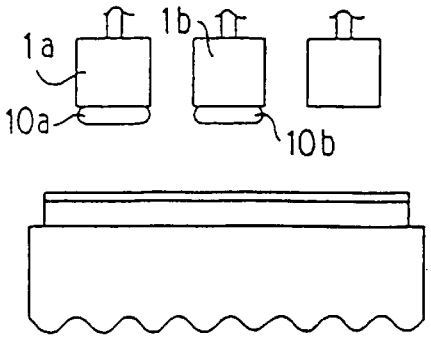
Figure 3D:
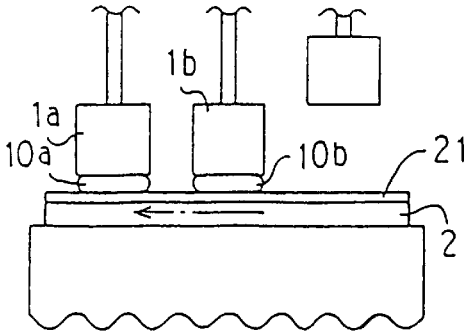
Figure 3E:
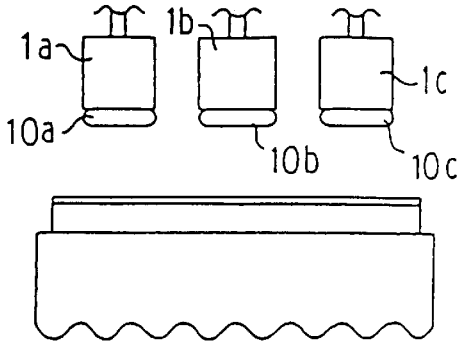
Figure 3F:
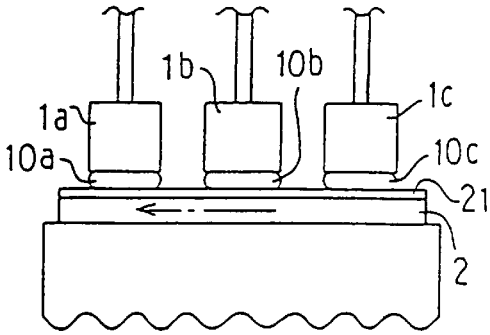
Figure 3G:
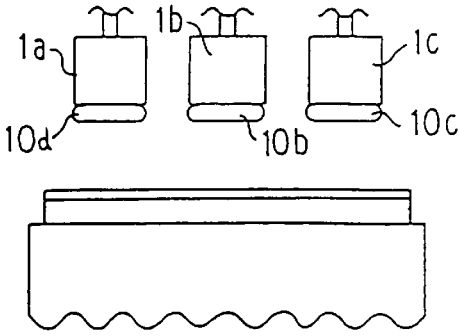
Figure 3H:
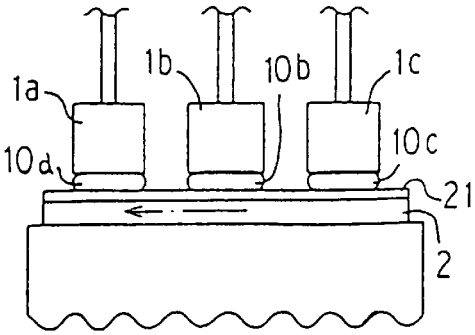
Figure 4:
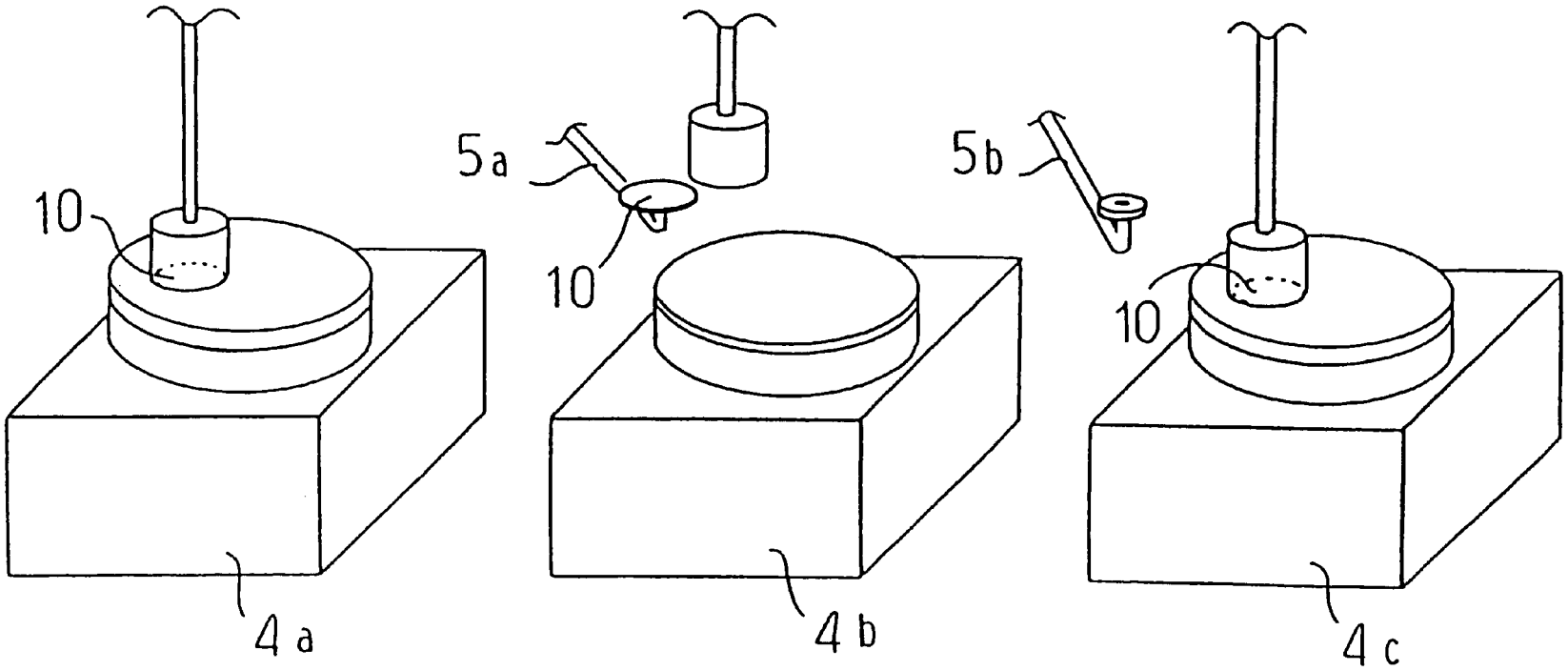
FIG. 4 (PRIOR ART)
FIG. 4 illustrates a multi-step polishing by a conventional polish apparatus.

Referring to FIG. 1, the polish apparatus includes a polish table 1 over which is provided with a horizontally-rotary base plate 2, and a first top ring 1*a,* a second top ring 1*b* and a third top ring 1*c,* which are independently controlled, over the base plate 2. Transfer apparatus 3*a*–3*c* which attach and detach the wafers to and from the top rings are provided in such a manner as to operate as linked with the top rings.

The upward and downward movements of the top rings 1*a*–1*c* are controlled independently so that the upward and downward movement of only one shaft or simultaneously with other shafts can be realized.

Moreover, the transfer apparatus 3*a*–3*c* each provided for each of the top rings attach semiconductor wafers to the respective top rings, remove the semiconductor wafers which have been polished and convey them to the next cleaning step.

Next, the multi-step polishing method by the polish apparatus according to the embodiment of the present invention will be described.

(1) A semiconductor wafer 10*a* is attached to the first top ring 1*a* (refer to FIG. 3(*a*)).

(2) The first top ring 1*a* is descended so that the semiconductor wafer 10*a* is brought into contact with a polishing cloth 21, and then the base plate 2 is rotated (refer to FIG. 3(*b*)).

(3) The first top ring 1*a* is lifted after about two minutes from the start of polishing to temporarily stop the polishing of the semiconductor wafer 10*a* for giving a rest, and, simultaneously, a second semiconductor wafer 10*b* is attached to the second top-ring 1*b* (refer to FIG. 3(*c*)).

(4) The first and second top rings 1*a* and 1*b* are descended so that the semiconductor wafers 10*a* and 10*b* are brought into contact with the polishing cloth 21 and the base plate 2 is rotated. Whereby a second polishing step for the semiconductor wafer 10*a* and a first polishing step for the semiconductor wafer 10*b* are carried out simultaneously (refer to FIG. 3(*d*)).

(5) The first top ring 1*a* and the second top ring 1*b* are lifted after about two minutes from the start of polishing to temporarily stop the polishing of the semiconductor wafers 10*a* and 10*b* for giving a rest, and, simultaneously, a third semiconductor wafer 10*c* is attached to the top ring 1*c* (refer to FIG. 3(*e*)).

(6) All the top rings are descended so that the semiconductor wafers 10*a*–10*c* are brought into contact with the polishing cloth 21 and the base plate 2 is rotated. Whereby, a third polishing step of the semiconductor wafer 10*a,* a second polishing step of the semiconductor wafer 10*b* and a first polishing step of the third semiconductor wafer 10*c* are carried out simultaneously (refer to FIG. 3(*f*)).

(7) All the top rings are lifted after about two minutes from the start of polishing to temporarily stop the polishing of the semiconductor wafers 10*b* and 10*c* for giving a rest and, simultaneously, the semiconductor wafer 10*a* is removed from the first top ring 1*a* by a transfer apparatus (not shown), and a next semiconductor wafer 10*d* is attached (refer to FIG. 3 (*g*)).

(8) All the top rings are descended so that the semiconductor wafers 10*b*–10*d* are brought into contact with the polish cloth 21 and the base plate 2 is rotated. Whereby, a third polishing step of the semiconductor wafer 10*b,* a second polishing step of the semiconductor wafer 10*c* and a first polishing step of the semiconductor wafer 10*d* are carried out simultaneously (refer to FIG. 3(*h*)).

By sequentially attaching and detaching the semiconductor wafers attached on the respective top rings, the three-step polishing is carried out for each semiconductor wafer, and one semiconductor wafer is conveyed for each two minute with one polish apparatus.

In the aforementioned embodiment, three top rings are utilized for performing the three-step polishing for the respective semiconductor wafers, however, it is not limited to the three steps. By providing two or more than four top rings, it is possible to perform two or more than four polishing steps, i.e., the required number of polishing can be set to be two or more than four, or the through put can be improved.

Furthermore, in the aforementioned embodiment, it is set that the required number of polishing be three times for each semiconductor wafer and the duration for each polishing time be two minutes, they are not constraints to the present invention. The invention may be so arranged that the required number of polishing for each semiconductor wafer and the duration for each step are preset, and a controller is provided for controlling attachment and detachment of the semiconductor wafer to and from the holding shafts and the upward and downward movement of the holding shafts in accordance with the preset values, so that the upward and downward movement of the holding shafts and the attachment and detachment of the wafers to and from the holding shafts can be carried out synchronously.

Alternatively, even though it is so arranged that the required number of polishing for each semiconductor wafer and the duration for each step are preset and a controller is provided for controlling the attachment and detachment of the semiconductor wafers to and from the holding shafts and the upward and downward movement of the holding shafts so that the upward and downward movement of the holding shafts and the attachment and detachment of the semiconductor wafers to and from the holding shafts can be carried out synchronously, the invention is not limited to this arrangement. The arrangement may be arbitrary so long as the upward and downward movement of each of the holding shafts and the attachment and detachment of the semiconductor wafers to and from the holding shafts can be operated independently.

Further, in the aforementioned embodiment, the polish table is a polishing cloth, however, it is not limited to the polishing cloth.

Furthermore, as stated in the aforementioned embodiment, by the arrangement that the number of the holding shafts of the controller is set to be equal to the required number of polishing steps for each semiconductor wafer, and that the wafers are sequentially shifted one-by-one, it is possible to extremely easily perform the multi-step polishing. In the aforementioned embodiment, the number of holding shafts is set to be three, however, the number is not limited to three. The number may be more than four, for example.

What is claimed is:

1. An apparatus for polishing semiconductor wafers, comprising:

a plurality of holding shafts for respectively holding the semiconductor wafers;

a polish table on which the semiconductor wafers are placed and polished; and means for moving the holding shafts between an upper position and a lower position and for individual operation of the holding shafts so that one or more of the holding shafts can be in the lower position while other of the holding shafts are in the upper position when polishing the semiconductor wafers, the upper position of the holding shafts adapted so that the semiconductor wafers attached thereto will not contact the polish table, and the lower position of the holding shafts adapted so that the semiconductor wafers attached thereto contact with the polish table for polishing thereof, thereby successive polishing of the semiconductor wafers can be performed periodically by shifting a mounting time of a respective semiconductor wafer without repeated attaching and detaching of the respective semiconductor wafer.

2. The apparatus as claimed in claim 1, wherein a required number of polishing steps for each of the semiconductor wafers and a duration for each polishing step are preset, and control means is provided for controlling the attachment of the semiconductor wafers to the holding shafts and the upward and downward movement of the holding shafts according to the preset values and the attachment and detachment of the semiconductor wafers to and from the holding shafts and the upward and downward movement of each of the holding shafts are carried out synchronously.

3. The apparatus as claimed in claim 1, wherein the polish table includes a polishing cloth.

4. The apparatus as claimed in claim 2, wherein the number of the holding shafts of the control means equals the number of polishing steps required for each of the semiconductor wafers.

5. The apparatus as claimed in claim 1, wherein the semiconductor wafers respectively require a number of polishing steps and each respective polishing step is carried out for a period of time, and the apparatus includes a control means having preset values defining the number of polishing steps and the period of time for each polishing step, the control means for controlling movement of the holding shafts to the upper and lower positions according to the preset values and for permitting selective attachment and detachment of respective semiconductor wafers to and from corresponding holding shafts when the holding shafts are in the upper position.

6. The apparatus as claimed in claim 1, wherein the semiconductor wafers respectively require a number of polishing steps and each respective polishing step is carried out for a period of time, and the apparatus includes a control means, having preset values that include the number of polishing steps and the period of time for each polishing step, for controlling the movement of the holding shafts to the upper and lower positions according to the preset values as follows:

a first holding shaft of the holding shafts is provided in the upper position and a first semiconductor wafer of the semiconductor wafers is attached thereto, and then the first holding shaft is moved to the lower position for polishing of the first semiconductor wafer, after the period of time for polishing has expired based on the preset values, the first holding shaft is return to the upper position, a second holding shaft of the holding shafts is provided in the upper position and a second semiconductor wafer of the semiconductor wafers is attached thereto, and then the first and second holding shafts are moved to the lower position for polishing of the first and second semiconductor wafers, and after the number of polishing steps and the period of time for each polishing step have been completed for the first semiconductor wafer based on the preset values, the first and second holding shafts are returned to the upper position, the first semiconductor wafer is removed from the first holding shaft, a new semiconductor wafer is attached to the first holding shaft, and then the first and second holding shafts are moved to the lower position for polishing of the new and second semiconductor wafers.

7. The apparatus as claimed in claim 1, wherein a number and a duration of polishing steps required for each semiconductor wafer are preset in advance as preset values and the apparatus further comprises a control means for controlling the attachment of the semiconductor wafers to the holding shafts according to the preset values so as to carry out of the attachment of each semiconductor wafer to and from the holding shafts and upward and downward movement of the holding shafts synchronously.

8. A method for periodic polishing of semiconductor wafers using an apparatus having a plurality of holding shafts for respectively holding the semiconductor wafers, and a polish table on which the semiconductor wafers are placed and polished, the holding shafts moving between an upper position away from the polish table and a lower position adjacent the polish table, the method comprising:

(A) moving a first holding shaft of the holding shafts to the upper position and attaching a semiconductor wafer to be polished to the first holding shaft, (B) lowering the first holding shaft to the lower position and polishing the semiconductor wafer attached thereto, (C) moving a second holding shaft of the holding shafts and the first holding shaft to the upper position and attaching a semiconductor wafer to be polished to the second holding shaft, (D) lowering the first and second holding shafts to the lower position and polishing the semiconductor wafers respectively attached to the first and second holding shafts, (E) moving the first and second holding shafts to the upper position and removing the semiconductor wafer attached to the first holding shaft, and attaching another semiconductor wafer to be polished to the first holding shaft, (F) repeating step (D), (G) moving the first and second holding shafts to the upper position and removing the semiconductor wafer attached to the second holding shaft, and attaching another semiconductor wafer to be polished to the second holding shaft, and (H) repeating step (D).

9. The method of claim 8, wherein steps (E) to (H) are repeated.

10. A method for periodic polishing of semiconductor wafers using an apparatus having a plurality of holding shafts for respectively holding the semiconductor wafers, and a polish table on which the semiconductor wafers are placed and polished, the method comprising:

periodically polishing each of the semiconductor wafers in a plurality of polishing steps, stopping polishing after each of the polishing steps, attaching and detaching semiconductor wafers to be polished from the holding shafts in a periodic manner when polishing is stopped, including at least one of attaching a new semiconductor wafer and removing a polished semiconductor wafer to and from one of the plurality of holding shafts while another semiconductor wafer is retained on another one of the plurality of holding shafts.

11. The method of claim 10, wherein the holding shafts move between an upper position away from the polish table and a lower position adjacent the polish table, and the method includes preset values defining a number of the polishing steps and the period of time for each polishing step, and the movement of the holding shafts to upper and lower positions and selective attachment and detachment of respective semiconductor wafers to and from corresponding holding shafts when the holding shafts are in the upper position is controlled based on the preset values.

12. The method of claim 10, wherein the holding shafts move between an upper position away from the polish table and a lower position adjacent the polish table, and the method includes preset values defining a number of the polishing steps and the period of time for each polishing step, and controlling the movement of the holding shafts to upper and lower positions according to the preset values as follows:

a first holding shaft of the holding shafts is provided in the upper position and a first semiconductor wafer of the semiconductor wafers is attached thereto, and then the first holding shaft is moved to the lower position for polishing of the first semiconductor wafer, after the period of time for polishing has expired based on the preset values, the first holding shaft is return to the upper position, a second holding shaft of the holding shafts is provided in the upper position and a second semiconductor wafer of the semiconductor wafers is attached thereto, and then the first and second holding shafts are moved to the lower position for polishing of the first and second semiconductor wafers, and after the number of polishing steps and the period of time for each polishing step have been completed for the first semiconductor wafer based on the preset values, the first and second holding shafts are returned to the upper position, the first semiconductor wafer is removed from the first holding shaft, a new semiconductor wafer is attached to the first holding shaft, and then the first and second holding shafts are moved to the lower position for polishing of the new and second semiconductor wafers.

13. The method of claim 10, wherein the method includes preset values defining a number of the polishing steps and the period of time for each polishing step, and the attaching and detaching of the semiconductor wafers to and from the holding shafts is carried out synchronously.

* * * * *